US006446615B2

(12) United States Patent
Stegmann et al.

(10) Patent No.: US 6,446,615 B2
(45) Date of Patent: Sep. 10, 2002

(54) METHOD AND ARRANGEMENT FOR DETECTING ICING IN PUMPS UTILIZED IN THE DIAGNOSIS OF TANK LEAKAGE IN MOTOR VEHICLES

(75) Inventors: Volker Stegmann, Bretten; Ralf Klein, Bad Wimpfen; Peter Wiltsch, Wimsheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/838,261

(22) Filed: Apr. 20, 2001

(30) Foreign Application Priority Data

Apr. 20, 2000 (DE) ..... 100 19 905

(51) Int. Cl.[7] ..... F02M 33/02
(52) U.S. Cl. ..... 123/520; 123/198 D; 73/119 R
(58) Field of Search ..... 123/516, 518, 123/519, 520, 521, 198 D; 73/119 R, 118.1, 117.3

(56) References Cited

U.S. PATENT DOCUMENTS

| | | | | |
|---|---|---|---|---|
| 5,349,935 A | * | 9/1994 | Mezger et al. | 123/198 D |
| 5,483,942 A | * | 1/1996 | Perry et al. | 123/198 D |
| 5,890,474 A | | 4/1999 | Schnaibel et al. | 123/520 |
| 5,967,124 A | * | 10/1999 | Cook et al. | 123/198 D |
| 6,105,557 A | * | 8/2000 | Schnaibel et al. | 123/198 D |
| 6,112,728 A | * | 9/2000 | Schwegler et al. | 123/198 D |
| 6,182,642 B1 | * | 2/2001 | Ohkuma | 123/519 |
| 6,363,921 B1 | * | 4/2002 | Cook et al. | 123/519 |

FOREIGN PATENT DOCUMENTS

| | | |
|---|---|---|
| DE | 19636431 | 3/1998 |
| EP | 0563724 | 10/1993 |

* cited by examiner

*Primary Examiner*—Willis R. Wolfe
*Assistant Examiner*—Hai Huynh
(74) *Attorney, Agent, or Firm*—Walter Ottesen

(57) ABSTRACT

A tank-venting system includes an active charcoal filter (20), which is connected to a tank (10). An intake manifold (40) of an internal combustion engine is connected to a tank-venting valve (30). The active charcoal filter (20) stores fuel vaporized in the tank (10). When the tank-venting valve (30) is driven open by the control unit (60), air from the ambient is drawn by suction through the active charcoal filter (20) and the fuel stored therein is released to the inducted air. A pump (50) is provided for checking the tightness of the tank-venting system and is connected to the control unit (60). A switchover valve (70) is connected downstream of the pump (50). A reference leak (81) is arranged in parallel to the switchover valve (70). A throughflow sensor (90) and a temperature sensor (91) are connected forward of the pump (50) which detect the scavenging air quantity, which is used to scavenge the active charcoal filter (20), as well as the intake air temperature. The sensors transmit the scavenging air quantity and the temperature to the control unit (60). Based on the scavenging air quantity and the intake air temperature, the control unit determines whether the pump (50) is iced at the particular time point. In case of a determination of "iced", the tightness measurement is not enabled by a control signal and/or the output of a fault signal, which indicates non-tightness of the tank-venting system, is suppressed.

14 Claims, 1 Drawing Sheet

METHOD AND ARRANGEMENT FOR DETECTING ICING IN PUMPS UTILIZED IN THE DIAGNOSIS OF TANK LEAKAGE IN MOTOR VEHICLES

FIELD OF THE INVENTION

The invention relates to a method and an arrangement for checking the operability and especially the tightness of a tank-venting system of a motor vehicle. The tank-venting system includes a tank, an adsorption filter and a tank-venting valve. The adsorption filter is connected to the tank via a connecting line and has a venting line. The tank-venting valve is connected to the adsorption filter via a valve line.

BACKGROUND OF THE INVENTION

In the above method and arrangement, a pump module is connected to the adsorption filter on the scavenging air end thereof. The pump module is utilized to introduce at time intervals an overpressure into the tank-venting system relative to the atmospheric pressure and the pressure trace of at least one operating characteristic variable of the tank-venting system, especially at least one operating characteristic variable of the pump module is detected when introducing the overpressure and a conclusion is drawn from this trace as to the presence of leakage in the tank-venting system and a corresponding fault signal is outputted. The adsorption filter is scavenged for regeneration at time intervals with the scavenging air inducted from the ambient of the vehicle.

In motor vehicles, tank-venting systems are increasingly utilized wherein the vaporized or excess fuel vapor is not conducted into the ambient but is directed via a venting line into an active charcoal filter (AKF). The fuel vapor or fuel gas is stored there in this filter and, during operation of the vehicle, the vapor or gas is supplied to an intake manifold of the internal combustion engine and therefore to the combustion via a clock-driven electromagnetic tank-venting valve. In this way, an emission of environmentally toxic fuel vapors (especially hydrocarbon vapors) from the tank into the ambient is substantially avoided and, at the same time, the vapors, which are supplied to the engine, are themselves used as fuel.

In these vehicles, the pump module (tank leakage pump module) is connected to the active charcoal filter at the fresh air end thereof. The storage capacity of the active charcoal filter becomes continuously less with increasing quantities of stored hydrocarbons and it is therefore necessary to regenerate the active charcoal filter at regular intervals, that is, to liberate the stored hydrocarbons from the active charcoal filter. This takes place by scavenging the active charcoal filter with fresh air. The active charcoal filter is connected via a regenerating valve to an intake manifold of the engine which serves to induct combustion air. By opening the regenerating valve, a pressure drop occurs between the active charcoal filter and the intake manifold by means of which hydrocarbons, which are stored in the active charcoal filter, are conducted into the intake manifold in order to be combusted in the engine and thereby disposed of.

In the above-mentioned arrangement of the pump module, fresh air is perforce passed through the pump module during the regenerating phases during which it is generally switched off. At the present time, the tank leakage pump modules for different types of vehicles are mounted at different installation locations and with induction air filters mounted likewise at different installation locations. Depending upon the installation location of the intake filter, heated air can be inducted and passed through the tank leakage pump module for an arrangement of the induction filter in the engine compartment. Alternatively, and in the case of an arrangement of the intake filter, for example, in the wheel housing, cold air can reach the tank leakage pump module during a scavenging phase of the active charcoal filter. The problem of icing of the tank leakage pump module can occur when there is scavenging with cold and damp air.

Even when scavenging with warm air (especially for a disturbance present in the active charcoal filter scavenging function), the problem is present that an iced or damp pump module is still iced or damp at the time point of carrying out a tank leakage diagnosis utilizing the tank leakage pump module whereby a trouble-free operation of the pump module is no longer ensured.

In both of the above-mentioned cases, dampness or icing in the pump module can lead to the situation that defective measurement results in a tank leakage diagnosis and therefore a leak in the tank system is erroneously detected.

In this context, reference is made to more rigorous statutory requirements for the operation of internal combustion engines which are being sought in several countries, such as in the United States, by the governments thereof. In accordance with these requirements, it is, for example, necessary that motor vehicles, which utilize volatile fuels such as gasoline, have a tank-venting system as mentioned initially herein which can also find an existing leak in the tank or in the entire fuel tank system.

SUMMARY OF THE INVENTION

It is an object of the invention to provide a method and an arrangement of the kind described above wherein an erroneous measurement, which is caused by icing and/or moisture in a tank leakage pump, is avoided as effectively as possible.

The method of the invention is for checking the operability of a tank-venting system of a motor vehicle including checking the tightness thereof. The tank-venting system includes a tank, an adsorption filter, a connecting line connecting the adsorption filter to the tank, the adsorption filter having a venting line, a tank-venting valve, a valve line connecting the tank-venting valve to the adsorption filter and a pump module connected to the adsorption filter. The method includes the steps of: operating the pump module from time to time to introduce an overpressure relative to atmospheric pressure into the tank-venting system; detecting the course of at least one operating characteristic variable of the tank-venting system indicative of the pressure therein when introducing the overpressure; from this course, drawing a conclusion as to the presence of a non-tightness of the tank-venting system; outputting a corresponding fault signal when a condition of the non-tightness is present in the tank-venting system; inducting scavenging air from the ambient of the vehicle and scavenging the adsorption filter with the scavenging air from time to time for regenerating the adsorption filter; detecting the temperature of the scavenging air and the quantity of the scavenging air supplied to the absorption filter during scavenging of the adsorption filter; and, drawing a conclusion from at least one of the temperature and the quantity as to whether the pump module is in one of the following states: frozen, thawed or demoisturized.

A special characteristic of the invention is that icing or moisture can be determined in the tank leakage pump module while considering the scavenging air quantity and the scavenging air temperature during the regeneration of the adsorption filter and, in this way, erroneous measurements can be effectively avoided in the tank leakage diagnosis. The scavenging air quantity is used to scavenge the adsorption filter and can be integrated via the scavenging rate and the intake air mass. By considering this scavenging air quantity, a clear determination can be made as to whether the tank leakage pump module, at the time point of consideration, is "iced", already again "deiced" or already again "demoisturized".

A first variation of the invention relates to the case wherein the tank leakage pump module or the intake air filter is mounted at a location of the vehicle protected from the outside temperature such as in the engine compartment of a motor vehicle. For this reason, and already after a short travel, warm air inducted via the filter is used for scavenging the adsorption filter with which a tank leakage pump module, which has become iced or moist in the interior, is deiced or demoisturized. If the scavenging with warm air did not take place long enough, it is assumed that the pump module is still iced or moist notwithstanding the relatively high intake air temperature or scavenging air temperature. In this case, a defective measurement during the tank leakage diagnosis because of icing or moisture is avoided in accordance with the invention in that the tank leakage diagnosis is enabled only after a minimum scavenging quantity.

In addition, it can be provided that the above-mentioned scavenging air integral is reset to the value ZERO after a pregiven scavenging-free time. The basis of this idea is, that also for scavenging with warm air, when a scavenging has not taken place for a longer time, the problem of the formation of condensate or of a renewed icing of the pump module is presented.

In a second variation, it is assumed that the tank leakage pump module or the induction air filter is mounted at a location unprotected from the outside temperature so that air at ambient temperature and possibly with high moisture is always inducted during the scavenging phase of the active charcoal filter. For this reason, an increased danger is present here that moisture reaches the pump module and that the pump module can become iced at correspondingly low ambient temperatures. For this reason, a maximum scavenging quantity with cold air (for example, cold inducted air at engine start) is used in order to draw a conclusion as to a possible icing for an erroneous diagnosis in the tank leakage pump measurement and to thereby suppress a leakage signal.

BRIEF DESCRIPTION OF THE DRAWING

The invention will now be described with reference to the single figure (FIG. 1) of the drawing which is a schematic of the tank-venting system wherein the method utilizing the invention is applied.

DESCRIPTION OF THE PREFERRED EMBODIMENTS

Figure 1:
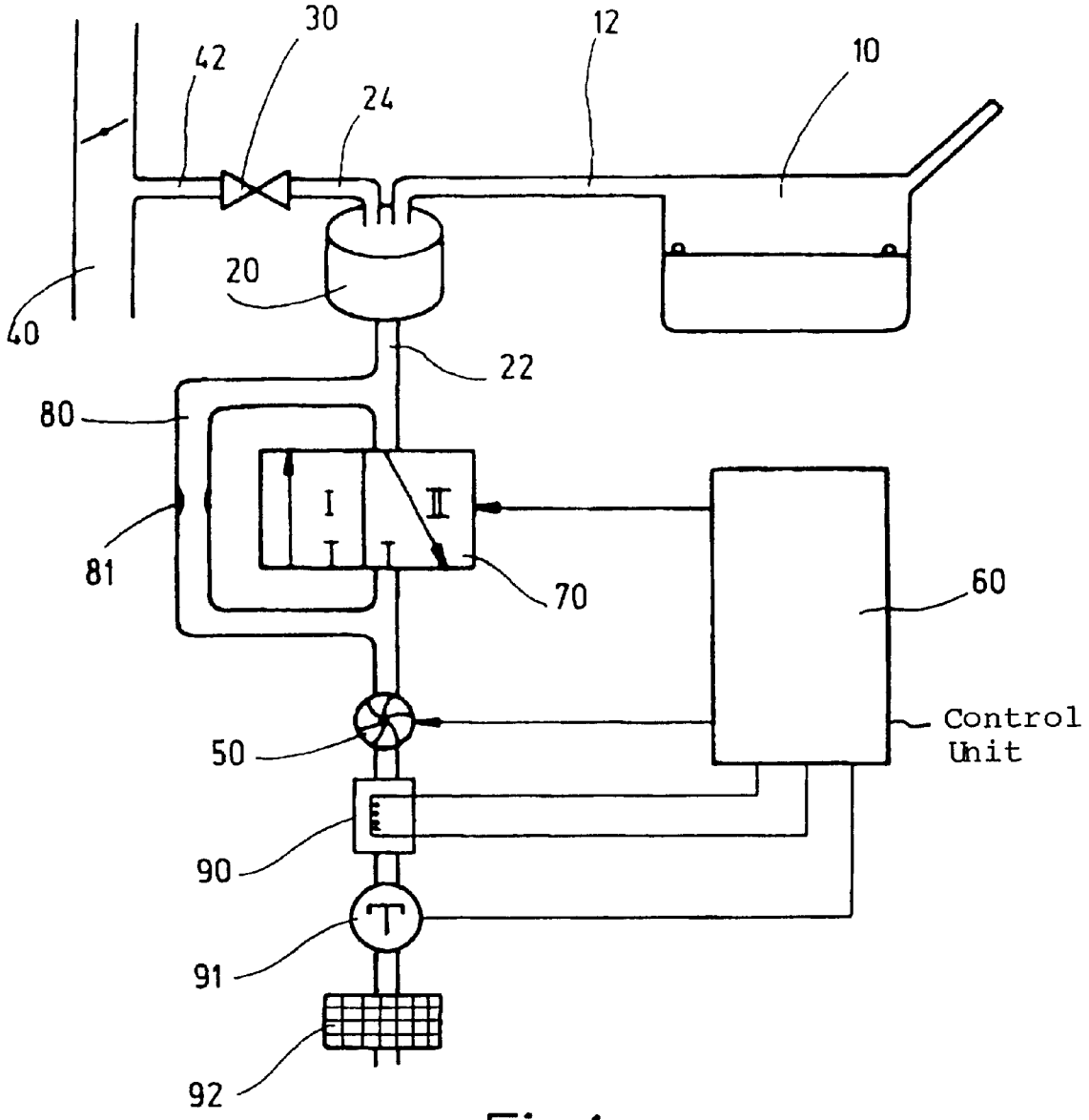

The tank-venting system shown in FIG. 1 includes an active charcoal filter 20 which is connected to a tank 10 via a tank connecting line 12. An intake manifold 40 of an internal combustion engine (not shown) is connected via a line 42 to a tank-venting valve 30. The active charcoal filter 20 stores fuel vaporized in the tank 10. When the tank-venting valve 30 is driven open by the control unit 60, air is drawn in by suction from the ambient through the active charcoal filter 20 which releases the stored fuel to the inducted air. Furthermore, the tank-venting system includes a passive filter 92 which pressure-conductingly connects the system to the atmosphere, that is, to the ambient of the vehicle.

During operation of the vehicle, that is its engine (not shown) or when tanking the tank 10, volatile hydrocarbon vapors form in the tank 10 which reach the active charcoal filter 20 via the line 12 and are reversibly bonded in the active charcoal filter in a manner known per se. The tank-venting valve 30 is normally closed. At regular time intervals, the tank-venting valve 30 is driven by the control unit 60 so that a specific partial pressure of the underpressure present in the intake manifold 40 is supplied to the charcoal filter 20 which leads to the condition that the stored hydrocarbon vapors are inducted into the intake manifold 40 via the line 24 and the tank-venting valve 30 in order to be supplied to the engine for combustion and therefore for final disposal. In this operation of the regeneration of the active charcoal filter 20, scavenging air is inducted into the active charcoal filter 20 via the line 22 and the passive filter 92 whereby the actual scavenging action is effected.

A pump 50 is provided in order to be able to diagnose the operability or tightness of the tank-venting system. The pump 50 is connected to the control unit 60 and a switchover valve 70 is connected downstream of the pump. The switchover valve 70 can, for example, be a 3/2 directional valve. A reference leak 81 is mounted in a separate branch 80 parallel to the switchover valve 70. The size of the reference leak 81 is so selected that it corresponds to the size of the leak to be detected.

The tightness check of the tank-venting system is disclosed in U.S. Pat. No. 5,890,474 incorporated herein by reference. By detecting the current supply to the pump motor, a determination is made as to whether the pump flow, which is to be brought into the tank-venting system by the pump 50, deviates from the pump flow which is present when introducing the overpressure via the reference leak.

A throughflow sensor 90 and a temperature sensor 91 can be connected ahead of the pump 50. The throughflow sensor detects the scavenging air quantity which is used to scavenge the active charcoal filter 20 and the sensor 91 detects the temperature of the inducted air. The sensors transmit the air quantity and the intake air temperature to the control unit 60. The throughflow sensor 90 can, for example, be an air mass sensor. In lieu of by sensors, the required variables of throughflow quantity and temperature can also be computed from data already present in the control unit 60 or can be estimated with adequate accuracy. On the basis of this data, the control unit makes a determination as to whether the pump 50, at the time point of consideration, is: iced, already defrosted, or already demoisturized.

In the control unit 60, computation means can be provided by means of which the scavenging rate and the induction air mass can be integrated and, together with the scavenging air temperature and the intake air temperature, the above-mentioned determination can be made. In the case of a determination that the pump 50 is iced, the tightness measurement by means of a control signal is not enabled and/or the output of a fault signal, which indicates non-tightness of the tank-venting system, is suppressed.

It is understood that the foregoing description is that of the preferred embodiments of the invention and that various changes and modifications may be made thereto without departing from the spirit and scope of the invention as defined in the appended claims.

What is claimed is:

1. A method for checking the operability of a tank-venting system of a motor vehicle including checking the tightness thereof, the tank-venting system including a tank, an adsorption filter, a connecting line connecting the adsorption filter to the tank, the adsorption filter having a venting line, a tank-venting valve, a valve line connecting the tank-venting valve to the adsorption filter and a pump module connected to the adsorption filter, the method comprising the steps of:

operating said pump module from time to time to introduce an overpressure relative to atmospheric pressure into said tank-venting system;

detecting the course of at least one operating characteristic variable of said tank-venting system indicative of the pressure therein when introducing said overpressure;

from said course, drawing a conclusion as to the presence of a non-tightness of said tank-venting system;

outputting a corresponding fault signal when a condition of said non-tightness is present in said tank-venting system;

inducting scavenging air from the ambient of said vehicle and scavenging said adsorption filter with said scavenging air from time to time for regenerating said adsorption filter;

detecting the temperature of said scavenging air and the quantity of said scavenging air supplied to said absorption filter during scavenging of said adsorption filter; and, drawing a conclusion from at least one of said temperature and said quantity as to whether said pump module is in one of the following states: frozen, thawed or demoisturized.

2. The method of claim 1, wherein said operating characteristic variable is an operating characteristic variable of said pump module.

3. The method of claim 1, wherein, when said pump module is in the frozen state, then carrying out at least one of the following steps: not enabling the tightness measurement and suppressing the output of said fault signal.

4. The method of claim 1, comprising the further step of computing said quantity of scavenging air with an integral formed from the scavenging rate and a mass of inducted air.

5. The method of claim 1, comprising the further step of enabling the measurement of tightness only after a minimal quantity of scavenging air.

6. The method of claim 4, comprising the further step of resetting said integral to zero after a pregiven time within which no scavenging has taken place.

7. The method of claim 1, comprising the further step of applying a maximum quantity of scavenging air with cold air.

8. The method of claim 7, wherein said cold air is intake air with a cold engine start.

9. A control unit for carrying out a method for checking the operability of a tank-venting system of a motor vehicle including checking the tightness thereof, the tank-venting system including a tank, an adsorption filter, a connecting line connecting the adsorption filter to the tank, the adsorption filter having a venting line, a tank-venting valve, a valve line connecting the tank-venting valve to the adsorption filter and a pump module connected to the adsorption filter, the control unit comprising:

means for operating said pump module from time to time to introduce an overpressure relative to atmospheric pressure into said tank-venting system;

means for detecting the course of at least one operating characteristic variable indicative of the pressure of said tank-venting system when introducing said overpressure;

means for drawing a conclusion from said course as to the presence of a non-tightness of said tank-venting system;

means for outputting a corresponding fault signal when a condition of said non-tightness is present in said tank-venting system;

means for operating said pump module for inducting scavenging air from the ambient of said vehicle and scavenging said adsorption filter with said scavenging air from time to time for regenerating said adsorption filter;

sensor means for detecting the temperature of said scavenging air and the quantity of said scavenging air supplied to said absorption filter during scavenging of said adsorption filter with said scavenging air; and, means for evaluating said temperature and said quantity as to whether said pump module is in one of the following states: frozen, thawed or demoisturized.

10. The control unit of claim 9, wherein said operating characteristic variable is an operating characteristic variable of said pump module.

11. The control unit of claim 9, wherein said evaluating means includes means for doing at least one of the following: suppressing the enablement of a tightness measurement in the case of said frozen condition, and suppressing a fault signal indicating a non-tightness of the tank-venting system.

12. A tank-venting system of a vehicle, the tank-venting system comprising:

a tank;

an adsorption filter having a venting line;

a connecting line connecting said adsorption filter to said tank;

a tank-venting valve;

a valve line connecting said tank-venting valve to said adsorption filter;

a pump module connected to said adsorption filter for introducing an overpressure in said tank-venting system relative to atmospheric pressure;

means for detecting the course of at least one operating characteristic variable of said tank-venting system indicative of the pressure therein while introducing said overpressure;

means for drawing a conclusion from said course as to the pressure of a non-tightness of said tank-venting system;

means for outputting a corresponding fault signal when a condition of said non-tightness is present in said tank-venting system;

means for operating said pump module for inducting scavenging air from the ambient of said vehicle and scavenging said adsorption filter with said scavenging air from time to time for regenerating said adsorption filter; and, sensor means for detecting the temperature of said scavenging air and the quantity of said scavenging air supplied to said absorption filter during scavenging of said adsorption filter with said scavenging air.

13. The tank-venting system of claim 12, wherein said operating characteristic variable is an operating characteristic variable of said pump module.

14. The tank-venting system of claim 12, further comprising a control unit for evaluating said temperature and said quantity as to whether said pump module is in one of the following states: frozen, thawed or demoisturized.

* * * * *